United States Patent [19]

Ichikawa et al.

[11] Patent Number: 4,842,647

[45] Date of Patent: Jun. 27, 1989

[54] MOULD ADDITIVE FOR CONTINUOUS CASTING OF STEEL

[75] Inventors: Kenji Ichikawa; Osamu Nomura, both of Bizen; Yoichiro Kawabe, Wake County; Koyo Yanagawa, Bizen, all of Japan

[73] Assignee: Shinagawa Refractories Co., Ltd., Tokyo, Japan

[21] Appl. No.: 154,211

[22] Filed: Feb. 10, 1988

[30] Foreign Application Priority Data

Feb. 12, 1987 [JP] Japan ..... 62-28293

[51] Int. Cl.[4] ..... B28B 7/36; C21C 7/00

[52] U.S. Cl. ..... 106/38.2; 75/53; 106/470; 106/485

[58] Field of Search ..... 75/53; 106/38.2, 470, 106/489

[56] References Cited

U.S. PATENT DOCUMENTS

| | | | |
|---|---|---|---|
| 3,290,163 | 12/1966 | Elbreder | 106/470 |
| 4,127,407 | 11/1978 | Eitel et al. | 75/53 |
| 4,594,105 | 6/1986 | Grim et al. | 75/53 |
| 4,731,111 | 3/1988 | Kopatz | 75/0.5 |

*Primary Examiner*—Theodore Morris

*Attorney, Agent, or Firm*—Wenderoth, Lind & Ponack

[57] ABSTRACT

The present invention offers a mould additive for continuous casting of steel characterized by having a fully spherical shape in which average particle size is in the range of 100 to 800 μm.

4 Claims, 1 Drawing Sheet

MOULD ADDITIVE FOR CONTINUOUS CASTING OF STEEL

BACKGROUND OF THE INVENTION

The present invention relates to a mould additive for continuous casting of steel. When steel is produced by continuous casting, a mould additive is indispensable and the quality of steel depends upon the quality of the mould additive.

When a mould additive is added to the surface of molten steel in a mould, it is fused gradually by the heat from the molten steel, to make three layers consisting of a fused layer, a semifused layer (sintered layer) and a layer of unfused additive.

The characteristics which such mould additive should have are as follows:

(1) heat insulation and oxidation prevention of molten steel surface;

(2) uniform fusibility;

(3) ability to absorb floating substances such as $Al_2O_3$ etc.;

(4) ability to lubricate between mould and solid shell of molten steel.

Among those characteristics, oxidation prevention, the ability to absorb floating substances and the lubricating ability are characteristics demanded for the fused layer of mould additive. On the other hand, heat insulation and uniform fusibility are required for the semifused layer (sintered layer) and the un-fused layer of mould additive, and these characteristics are greatly influenced by the shape of the mould additive particles.

The shape of conventional mould additive can roughly be divided into three types, that is powdery, granular (columnar shape: average grain size about 1 to 3mm, FIG. 2) and spherical (hollow type), and among them the powdery and granular types are chiefly used.

Powdery types are comparatively more advantageous in heat insulation than granular types and characteristically slag faster due to their large specific surface area. Therefore powdery type mould additive are used mainly for low carbon aluminum-killed steel which is easily affected by contamination defects such as pinholes and blow holes, as well as for high speed continuous casting where casting speed is at least 1.6m/min in which even speedier slagging and even speedier influx are required.

Granular types are superior from an environmental aspect because they generate less dust, and they also have such merits as uniform fusing of the granular layer, and the uneven distribution of additive ingredients is small so the composition of the slag is also uniform. For these reasons, granular additives are mainly used for medium carbon steels which require uniform fusion and uniform influx of the additive or for use in low speed casting which gives priority to environmental problems.

Hollow spherical types have many superior points environmentally, in fluidity in a mould and in heat insulation of molten steel but there are few examples of use in actual casting units.

Although the three types of mould additives described above have many merits respectively, they also have the following drawbacks.

DRAWBACKS OF POWDERY MOULD ADDITIVES (1) Environmental problems such as the generation of dust or fires when being fed into the mould.

(2) There is a risk of uneven distribution of additive ingredients compared with granular types.

(3) Due to non-uniform fusion and non-uniform influx of the additive to the spaces between the mould and the solid shell of molten steel, it is difficult to perform even lubrication between the mould and the solid shell of molten steel compareed with granular types. As a result, the solid shell is unevenly cooled resulting in higher probability of surface cracks in the cast steel.

Accordingly it is difficult to use powdery type mould additives for steel which is susceptible to cracks, such as medium carbon steel and stainless steel.

DRAWBACKS OF GRANULAR MOULD ADDITIVES (1) Less thermal insulation than powder type additives.

(2) Slower slagging than powdery types, making it unsuitable adoption for high speed casting of steel.

(3) Not applicable for automatic feeders commonly adapted in iron and steel works, because conventional granular type mould additives are fragile, break easily during transportation and have less spreadability in a mould. Therefore, most iron and steel works use a powdery mould additive when they use automatic feeders.

DRAWBACKS OF HOLLOW SPHERICAL MOULD POWDER

The spherical type (hollow type) of mould powder (Japanese Patent Laid Open Nos. 52-123330 and 54-75427) has good thermal insulation and good spreadability in a mould, but has problems in fusion properties, so there are few examples of its application in actual units. The hollow spherical type mould additive fuses layer by layer like a granular type, but air occluded inside the hollow sphere cannot be evacuated completely during fusing. Because of this remaining air the hollow spherical type additive shows good heat insulation, but on the other hand this makes it difficult to transfer heat from the molten steel to the upper part of the mould additive. As a result, slagging speed tends to be decreased and a constant influx of slag into the interface between the mould and the solid sheel of molten steel is restricted. Thus, it is difficult to balance the amount slag influx and the rate of slagging, with a hollow spherical additive. Since slagging speed is restricted, it is difficult to use a spherical type (hollow type) mould additive for high speed casting of steel which requires speedy slagging and speedy influx of slag.

Thus conventional mould additive such as powdery, granular and hollow spherical types have respective merits and demerits respective with none of them being satisfactory mould additives.

SUMMARY OF THE INVENTION

To resolve the above described problems, the inventors of the present invention performed various investigations into the shapes of the mould additives and as a result arrived at the present invention.

Thus the present invention presents a mould additive for continuous casting of steel which is fully spherical having an average particle size of 100 to 800 μm.

DETAILED DESCRIPTION OF THE INVENTION

Figure 1:
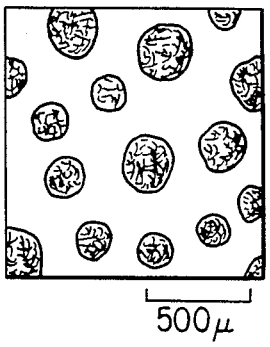
FIG. 1 is a figure of a fully spherical type mould additive for continuous casting of steel of the present invention.
Figure 2:
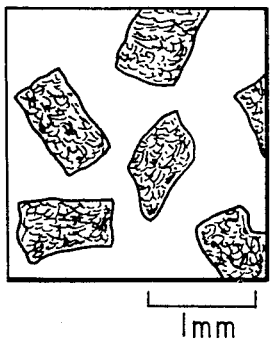
FIG. 2 is a figure of a conventional granular type mould additive.
Figure 3:
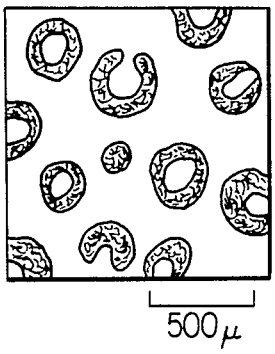
FIG. 3 is a figure of a conventional spherical type (hollow type) mould additive.

As shown in FIG. 1, the mould additive for continuous casting of steel of the present invention largely differs from the conventional spherical type (hollow type) mould additive shown in FIG. 3 in shape.

The characteristic of the mold additive of the present invention is that it is a fully spherical type mould additive. Although, this can include some amount of convex spheres, there are no hollow type spheres as shown in FIG. 3. Average particle size of the full sphere is 100 to 800 μm, and preferably 200 to 400 μm.

If average particle size were under 100 μm, dust generation might occur as with powdery additives so this is not preferable, and if average particle size were over 800 μm, the vacant space among particles is increased reducing thermal insulation just as with conventional granular types.

The fully spherical particles of the present invention can be produced in many ways such as granulation by spraying, rolling pan, fludizing, agitation, etc.

The mould additive for continuous casting of the present invention has excellent properties in thermal insulation, slagging tendency and uniform fusibility so it can be applied to low carbon steel, middle carbon steel and/or low speed casting and high speed casting. Furthermore, as it has excellent fluidity properties, it is easily applicable to automatic feeders.

In order to explain the present invention in more detail the following, examples are presented.

EXAMPLE 1

A conventional granular mould additive normally used for low speed casting of low carbon steel as controls and the fully spherical type mould additive of the present invention (present invention, product 1) having the same composition as said control (No. 2) as well as hollow and powdery type additives (1 and 3) were used for continuous casting of low carbon aluminum killed steel.

Casting conditions were a speed of 1.0 to 1.2m/min and a mold size of 220'1250mm. The test results are shown in Table 1.

TABLE 1

| | | Conventional Product | | | Present Invention |
|---|---|---|---|---|---|
| | | 1 | 2 | 3 | 1 |
| Chemical Composition % | $SiO_2$ | 40.1 | 41.0 | 40.4 | 41.0 |
| | $Al_2O_3$ | 5.0 | 4.5 | 4.8 | 4.5 |
| | CaO | 32.0 | 31.5 | 32.3 | 31.5 |
| | $R_2O$ | 11.7 | 11.5 | 11.9 | 11.5 |
| | F | 6.9 | 7.0 | 7.2 | 7.0 |
| | F.C. | 4.5 | 4.5 | 4.5 | 4.5 |
| | $CaO/SiO_2$ | 0.80 | 0.77 | 0.80 | 0.77 |
| Shape | | powder | columnar granule | hollow spherical | fully spherical |
| Average grain size (μm) | | 40 | 1300 | 500 | 280 |
| Bulk density (g/cm$^3$) | | 0.76 | 0.90 | 0.65 | 0.82 |
| Angle of repose (°) | | 42 | 34 | 27 | 28 |
| Amount of slag influx (kg/t) | | 0.50 | 0.47 | 0.39 | 0.51 |
| Frequency of slag bare generation | | no | yes | a little | no |
| Frequency of dust generation | | big | little | little | little |
| Spreading tendency | | little bad | bad | good | good |
| Contamination index under surface | | 1.0 | 1.2 | 2.3 | 1.0 |
| Softening temperature (°C.) | | 1045 | 1040 | 1030 | 1040 |
| Viscosity (1300° C., Poise) | | 3.4 | 3.2 | 3.3 | 3.2 |

*Foot more: $R_2O$ represents $Na_2O + K_2O + Li_2O$

Contamination index under surface: put conventional product 1 as 1.0.

As apparent from Table 1, the present invention product showed good results compared with a conventional granular mould additives or hollow spherical mould additives and almost the same results as those of a conventional powdery mould additive.

EXAMPLE 2

A fully spherical type mould additive (present invention, product 2) was made which had the same composition as the conventional granular mould additive which was used for medium carbon low speed casting in Example 1.

Said full sphere type mould additive was used for medium carbon aluminum killed steel continuous casting.

The casting conditions were a speed of 1.0 to 1.2 m/min, and a mold size of 220×1250 mm.

The casting results are shown in Table 2.

TABLE 2

| | | Conventional Product | | | Present Invention |
|---|---|---|---|---|---|
| | | 4 | 5 | 6 | 2 |
| Chemical Composition % | $SiO_2$ | 37.4 | 37.3 | 36.5 | 37.3 |
| | $Al_2O_3$ | 5.5 | 6.0 | 6.3 | 6.0 |
| | CaO | 37.5 | 38.0 | 37.9 | 38.0 |
| | $R_2O$ | 9.7 | 9.5 | 9.9 | 9.5 |

TABLE 2-continued

| | Conventional Product | | | Present Invention |
|---|---|---|---|---|
| | 4 | 5 | 6 | 2 |
| F | 7.0 | 6.8 | 6.6 | 6.8 |
| F.C. | 4.2 | 4.2 | 4.2 | 4.2 |
| $CaO/SiO_2$ | 1.00 | 1.02 | 1.04 | 1.02 |
| Shape | power | columnar granule | hollow spherical | fully spherical |
| Average grain size (μm) | 40 | 1400 | 500 | 270 |
| Bulk density (g/cm$^3$) | 0.78 | 0.91 | 0.65 | 0.82 |
| Angle of repose (°) | 42 | 35 | 27 | 27 |
| Amount of slag influx (kg/t) | 0.47 | 0.43 | 0.33 | 0.47 |
| Frequency of slag bare generation | no | a little | a little | no |
| Frequency of dust generation | big | little | little | little |
| Spreading tendency | little bad | bad | good | good |
| Surface crack index | 1.0 | 0.5 | 1.2 | 0.5 |
| Softening temperature (°) | 1110 | 1120 | 1120 | 1120 |
| Viscosity (1300° C., Poise) | 2.2 | 2.4 | 2.5 | 2.4 |

*Foot note: $R_2O$ represents $Na_2O + K_2O + Li_2O$
Surface crack (whole length) index: put conventional product 4 as 1.0.

As can be seen from Table 2, the present invention product 2 showed a lower surface crack index than a conventional powdery mould addtive or hollow spherical mould additive and the same results as a conventional granular mould additive.

EFFECT OF THE INVENTION

The present invention has eliminated the draw-backs of the conventional mould additives for continuous casting of steel by adopting a fully spherical type mould additive having an average particle size of 100 to 800 μm. Thus the following fevorable effects were obtained.

(1) No dust generation which is desirable environmentally.

(2) Excellent fluidity of mould additive, enabling easy application in automatic feeders.

(3) Uniform layer fusibility and constant influx in a mould, which is the same as conventional granular mould additives. Also, there is excellent slagging ability and none of the bubbles after fusing seen from conventional hollow spherical mould additives.

(4) Good thermal insulation which is the same as a conventional powdery mould power.

What is claimed is:

1. In a mould additive for the continuous casting of steel, which mould additive has uniform fusibility, imparts heat insulation and oxidative preventive properties to the molten steel, serves as a lubricant between the molten steel surface and the mould, and absorbs floating substances on the steel, the improvement wherein the mould additive has an essentially spherical and non-hollow shape, a bulk density of about 0.82 gm/cm$^3$ and an average grain size in the range of 100 to 800 μm, said mould additive comprising the following ingredients:

| | |
|---|---|
| $SiO_2$ | 20–50% |
| $Al_2O_3$ | 0–10% |
| CaO | 20–45% |
| $R_2O$ ($Na_2O + K_2O + Li_2O$) | 3–25 |
| F | 2–15% |
| Free Carbon | 0.5–10% |
| MgO | 0–10% |
| $B_2O_3$ | 0–10% |
| $Fe_2O_3$ | 0–5% |
| BaO | 0–10% |

2. The mould additive for continuous casting described in claim 1, wherein said average particle size is in the range of 200 to 400 μm.

3. The mould additive for continuous casting of steel described in claim 1, wherein the $CaO/SiO_2$ ratio is in a range of between 0.5–1.5.

4. The mould additive for the continuous casting of steel described in claim 1, wherein said mould additive is produced by granulation by spraying, by means of a rolling pan, by fluidizing or by agitation.

* * * * *